US012163200B2

(12) United States Patent
Mueller et al.

(10) Patent No.: US 12,163,200 B2
(45) Date of Patent: Dec. 10, 2024

(54) SHIELD FOR HEAT TREATING A PLATE WORKPIECE

(71) Applicants: Bjoern Mueller, Attendorn (DE); Patrick Mueller, Kirchhundem (DE); Maik Winderlich, Drolshagen (DE); Thorsten Wisnia, Attendorn (DE)

(72) Inventors: Bjoern Mueller, Attendorn (DE); Patrick Mueller, Kirchhundem (DE); Maik Winderlich, Drolshagen (DE); Thorsten Wisnia, Attendorn (DE)

(73) Assignee: GEDIA GEBRUEDER DINGERKUS GMBH, Attendorn (DE)

( * ) Notice: Subject to any disclaimer, the term of this patent is extended or adjusted under 35 U.S.C. 154(b) by 25 days.

(21) Appl. No.: 17/994,431

(22) Filed: Nov. 28, 2022

(65) Prior Publication Data

US 2023/0167521 A1 Jun. 1, 2023

(30) Foreign Application Priority Data

Dec. 1, 2021 (DE) ..... 102021131567.0

(51) Int. Cl.
*C21D 9/00* (2006.01)
*C21D 1/34* (2006.01)

(52) U.S. Cl.
CPC ..... *C21D 9/0006* (2013.01); *C21D 1/34* (2013.01); *C21D 9/0081* (2013.01); *C21D 2221/00* (2013.01)

(58) Field of Classification Search
CPC ..... C21D 9/0006; C21D 1/34; C21D 9/0081; C21D 2221/00; C21D 9/46; C21D 9/48; C21D 9/0025; C21D 1/673; C21D 2221/02; B21D 22/022
See application file for complete search history.

(56) References Cited

U.S. PATENT DOCUMENTS

2011/0042369 A1* 2/2011 Ishiguro ..... C21D 1/673 219/539

FOREIGN PATENT DOCUMENTS

EP 3778054 B1 * 12/2021 ..... B21D 37/16
WO WO-2013189597 A1 * 12/2013 ..... B21J 1/06

OTHER PUBLICATIONS

Machine Translation of WO-2013189597-A1 (Year: 2013).*

* cited by examiner

*Primary Examiner* — Keith Walker
*Assistant Examiner* — Ryan L Heckman
(74) *Attorney, Agent, or Firm* — Andrew Wilford

(57) ABSTRACT

A method of tempering a plate workpiece entails first fitting the plate workpiece with a shield between first and second shield parts each having a respective mask element so as to cover only an edge region of the workpiece while leaving a more central region of the workpiece exposed. The shield and workpiece are then put in an oven with the plate workpiece fitted between the first and second shield parts. The shield also comprises first and second seals on the first and second parts confronting each other and each displaceable on the respective part between a closely juxtaposed working position in which inner portions of the seals are spaced apart by a distance equal generally to a thickness of the plate workpiece and outer portions of the seal bear on each other and a starting position spaced more widely from and out of engagement with each other. The seals engage and clamp the workpiece in the working position.

12 Claims, 2 Drawing Sheets

SHIELD FOR HEAT TREATING A PLATE WORKPIECE

FIELD OF THE INVENTION

The present invention relates to a method of heat treating a plate workpiece. More particularly this invention concerns a shield used with such a method.

BACKGROUND OF THE INVENTION

It is known to differentially heat treat a workpiece, typically of steel, such that when cooled some parts of the workpiece have a different hardness and deformability than other parts. In the manufacture of automobiles plates are often needed that have, for instance, a very rigid central region and somewhat more malleable edges.

This is achieved by fitting the plate workpiece to a shield having two parts between which the plate workpiece is sandwiched and that each carry a mask element used to cover a part of the workpiece when it is in an annealing oven to protect the covered part and prevent it from reaching austenitizing temperature while the unmasked or uncovered regions are heated to this temperature. To this end the shields grip or are closely juxtaposed with the workpiece, fitting to its edge and forming a gap sufficiently wider than the thickness of the workpiece.

According to the invention, temperatures slightly below Ac3 or even above Ac3 are also recorded. It is not necessary to set the exact Ac3 temperature.

After a certain dwell time, the plate is removed from the furnace and shaped into a molded part in a die and hardened. The dwell time is such that the covered areas have reached a predetermined temperature below the austenitizing temperature and above the martensite start temperature, with the uncovered central region at austenitizing temperature.

Because the plate has areas with such different temperatures before it is shaped, after shaping and hardening the molded part has corresponding areas with different strengths, namely hard and soft areas or high-strength and ductile areas.

However, the shielding has the disadvantage that an undesirable transition area is formed between the hard and soft areas, which is of average strength. The transition area is caused by the fact that when the plate is heated in the furnace, part of the heat passes through the gap between the parts and through the gap between the mask elements and the plate to the covered area, so that part of the covered area is also heated despite the shielding. After forming the plate, this heated area becomes the undesired transition area that has medium strength. Thus, in the prior art no sharp demarcation is achieved between the area of the plate heated or held to austenitizing temperature, which has high strength after forming, and the covered portion of the plate that is relatively soft after shaping.

Due to the undesired heat input to the covered region of the plate workpiece, cooling is slowed down and a relatively long dwell time is necessary until the covered area has reached the desired temperature, and the uncovered central region must be continuously heated during the dwell time. Energy consumption is correspondingly high.

OBJECTS OF THE INVENTION

It is therefore an object of the present invention to provide an improved shield for heat treating a plate workpiece.

Another object is the provision of such an improved shield for heat treating a plate workpiece that overcomes the above-given disadvantages, in particular that minimizes the size of the transition zone in a differentially tempered workpiece.

A further object is to provide an improved method of thus treating a workpiece using the shield of this invention.

SUMMARY OF THE INVENTION

A method of tempering a plate workpiece entails first fitting the plate workpiece with a shield between first and second shield parts each having a respective mask element so as to cover only an edge region of the workpiece while leaving a more central region of the workpiece exposed. The shield and workpiece are then put in an oven with the plate workpiece fitted between the first and second shield parts. The shield also comprises first and second seals on the first and second parts confronting each other and each displaceable on the respective part between a closely juxtaposed working position in which inner portions of the seals are spaced apart by a distance equal generally to a thickness of the plate workpiece and outer portions of the seal bear on each other and a starting position spaced more widely from and out of engagement with each other. The seals engage and clamp the workpiece in the working position.

Thus the first and second seals are spaced apart from one another and from the plate workpiece in a starting position and are brought closer to one another in a working position, so that the seals are brought closely together, forming a gap on a first part of the plate workpiece and/or lie against one another on their end faces in a second part which is arranged next to the plate workpiece.

The seals are preferably arranged in pairs on the shield, one seal being attached to the first part and one seal being attached to the second part, and the seals of each pair are closer to each other in the working position.

In the working position, the seals of a pair of mask elements can be brought closer to each other in a first region of the plate, so that the gaps between the mask elements and the plate are at least partially closed and the covered region of the plate is reliably shielded. As a result, almost no more heat reaches the covered region of the plate and a wide, diffuse transition area between the hard and soft areas after the plate has been formed is avoided. The seals are fitted to the plate with gap formation and preferably do not come quite into contact with the plate. In this way, the shielding can be carried out inexpensively and at least almost without wear.

In addition or alternatively, the seals of a pair of seals can be brought closer to each other in the working position in a second part next to the plate and lie with their end faces against each other. In this way, the gap between the mask elements is securely closed and shielding of the edge of the plate further into the furnace is ensured.

The seals can be designed and shaped in such a way that one part of the seals is fits roughly to the first part of the plate and another part of the seals fits roughly to each other in the second part of the plate. Such a design is possible, for example, if the seals have an approximately U-shaped or V-shaped cross section and, in the working position, a pair of legs is approximately in the first part region and a further pair of legs is adjacent to each other in the second part region, and the plate workpiece seam is arranged and shielded in a space between the legs.

Almost no heat can reach the covered area through the seals, so that it cools more quickly to the predetermined temperature. As a result, a significantly shorter dwell time in the oven is achieved and considerable energy savings are possible.

Preferably, at least one first seal is attached to the first mask element and at least one second seal is attached to the second mask element, and the mask elements and the seals attached thereto are congruent with each other and are congruently opposite each other.

As a result, the seals lie exactly against each other at the end faces in the working position and the gap between the seals and between the mask elements and the plate workpiece is optimally closed, so that very little or no heat can reach the covered area through the gap.

Further first seals can also be provided on the first mask element and further second seals can be provided on the second mask element, the first seals each being designed congruent with the second seals and being congruent with the latter. Further orifices with further seals can also be attached to the parts in a corresponding manner.

In this case, it is preferably provided that the first seal, in the starting position, terminates with an end face at least flush with a first face of the first mask element facing the plate or is recessed in this surface, and the second seal, in the starting position, terminates with an end face at least flush with a second face of the second mask element facing the plate or is recessed in this surface, the seals projecting beyond the surfaces of the covers in the working position.

The plate workpiece can be inserted in a simple manner between the first and second parts and placed between the mask elements without it hitting or jamming against the mask elements as long as the seals are in their starting position. Removal of the plate workpiece is also simplified in this way.

After the seals have been moved into the working position, they project past the faces of the mask elements and at least partially close the gaps between the mask elements and also between the mask elements and the plate. It is then no longer possible to insert or remove the plate.

It is also preferred that the seals consist of several seals. Also, different seals can be combined to form a seal and, as a result, even complicated geometries can be shielded.

It is preferably provided that the shield has for each seal a recess in which the seal is displaceably guided and for movement transversely to the plane of the plate workpiece, the first seal being completely in the first recess when it is displaced into the starting position and terminating at least flush with the first face of the mask element facing the plate workpiece or recessed in the face, and the second seal, when in the starting position, is completely in the second recess and terminates at least flush with the second face of the mask element facing the plate or is recessed in the face, and the seals project beyond the surfaces when moved into the working position.

The recesses are dimensioned in such a way that the respective seal is completely in its recess in the starting position and its end face is preferably flush with the surface of the cover. The recess is formed as a guide allowing movement of the seal to the working position in which the seal projects above the surface of the shielding part.

In addition, the shield is connected to a cooler whose coolant flows through the shield during positioning in the furnace and the seals being adjusted into the working position by the pressure of the cooler. Thus the cooler and coolant serve not only to cool the shield, but also to actuate the seals. The shield is supplied with a coolant via the cooler, with the coolant flowing through the shield as soon as it is put into operation in the furnace. The system pressure in the cooler acts on the seals so that they are moved into the working position. In this way, a particularly simple and cost-effective adjustment is possible.

It is preferred that the seals are each biased to the starting position by a spring. The spring can, for example, be a tension spring by means of which the seals are pulled back into the starting position after the system pressure in the coolant circuit drops. This solution is particularly cost-effective and easy to implement.

It is preferably provided that the seals are of U-section, the first seal having a long inner leg and a short outer leg, and the second seal having a long second leg and a short second leg. These seals in the working position are positioned with the short legs at the first region of the plate, forming a gap, and with the long legs bearing on each other in the second region.

The long legs of the seals bear against each other next to the plate on the face side. The short legs enclose the plate. These are closely approximated to the plate, leaving a small gap between the end faces of the short legs and the plate to allow cost-effective and wear-free shielding. This design of the seals makes it possible to completely shield an edge of the plate with a single pair of seals.

Alternatively, the long and short legs can each be formed by a seal. Preferably, it is also provided that the first part and the second part have further mask elements with seals thereon. This allows further areas of the plate workpiece to be shielded accordingly. It can also preferably be provided that the parts and the mask elements are formed in one piece. This enables cost-effective manufacture of the shield.

Alternatively, the parts and the mask elements and the seals are formed in multiple parts and are detachably connected to one another. This allows the mask elements to be exchanged so that the shield can be adapted to the product to be shielded. The seals are preferably detachably attached to the mask elements and can also be exchanged. This makes it possible, for example, to adapt the shield to plate workpieces with different thicknesses. This creates a particularly flexible system that can be individually adapted to different products. It is preferably provided that the parts consist of several mask elements which are assembled to form a shielding part.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
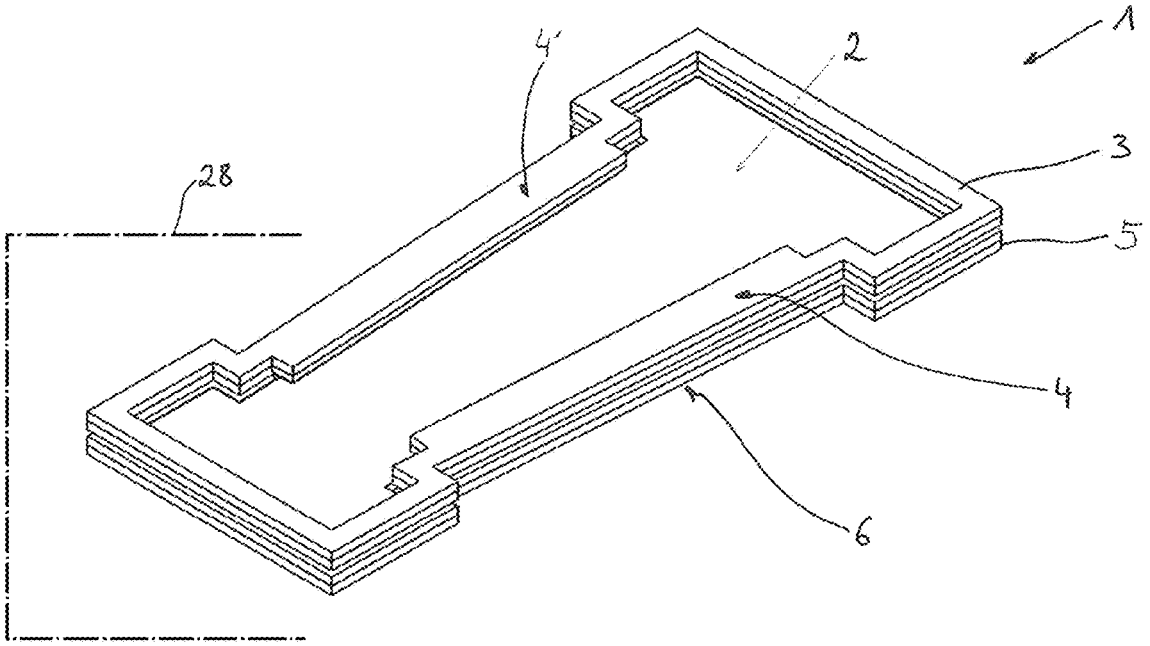
FIG. 1 is a perspective view of the shield according to the invention.
Figure 2:
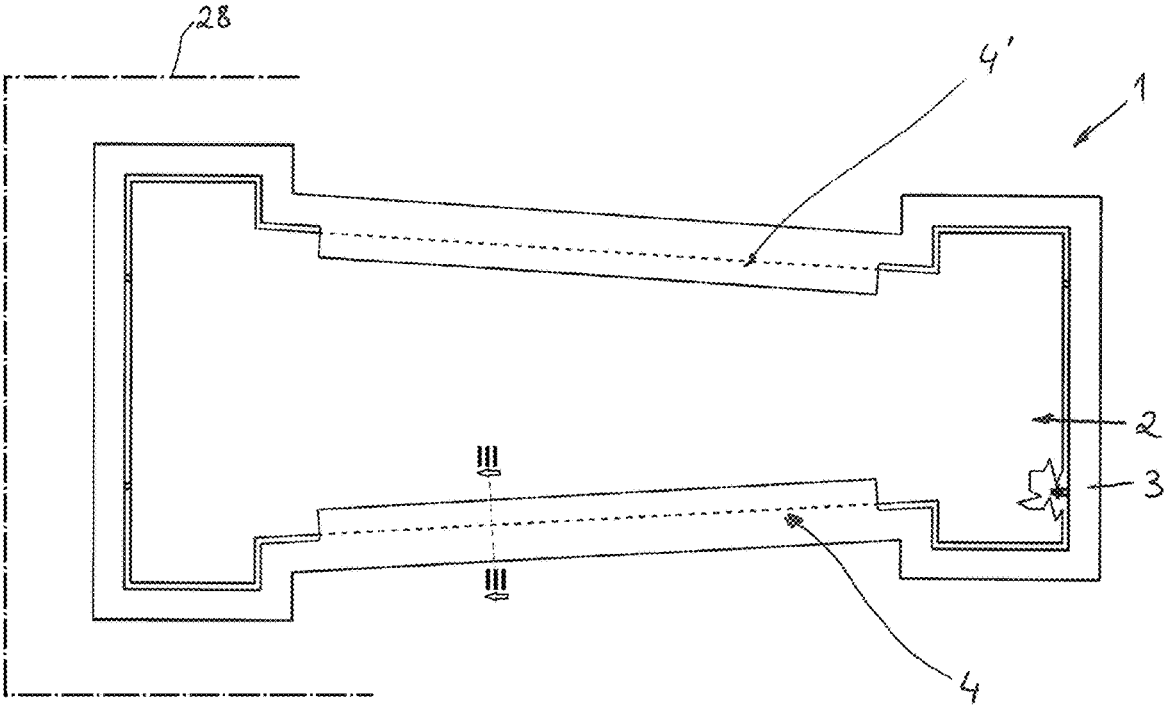
FIG. 2 is a top view of the shield.

As seen in FIG. 1, a shield 1 covers at least part of a workpiece plate 2 during tempering of the workpiece 2 in a furnace. The shield 1 is put into a furnace together with a workpiece 2 and then heated approximately to austenitizing temperature for treatment of the plate. The furnace is indicated by a dashed line 28 in the drawing.

The shield 1 has a first part 3 with an elongated first mask element 4 and an second part 5 opposite this with a second elongated mask element 6. The parts 3 and 5 are each formed as a closed generally rectangular frame and also each have, opposite their first mask elements 4 and 6, elongated second mask elements of which only the first mask element 4' is shown. The first part 3 is formed integrally with the respective mask elements 4 and 4' and the second part 5 is similarly formed of one piece with its respective mask elements of which only element 6 is shown. This makes it possible to manufacture the shield 1 at low cost.

The position of the workpiece 2 between the first mask element 4 and the second mask element 6 is described below. These explanations apply equally to the arrangement of a further part of the printed workpiece 2 between further pairs of mask elements.

A central region of the plate workpiece 2 is exposed between arranged between the mask elements 4 and 6. To each side the respective edge of the plate workpiece 2 is covered by the first and second mask elements 4 and 6 such that the covered regions of the workpiece 2 are shielded by the shield 1 against further heat application and slowly cools down to a temperature below the austenitizing temperature, in fact close to the martensite start temperature.

The uncovered central region of the workpiece 2 is thus maintained at austenitizing temperature or heated by the heat application.

Bar seals 8 and 9 are provided on the mask elements 4 and 6 to improve and more precisely shield the covered region of the workpiece 2 so that no or only very narrow transition areas between hard and soft areas are produced during subsequent shaping and hardening. In addition, the improved shielding makes it possible to cool the subareas to a desired temperature more quickly, so that the dwell time of the workpiece 2 in the furnace can be significantly reduced and considerable energy savings are the result.

Figure 3:
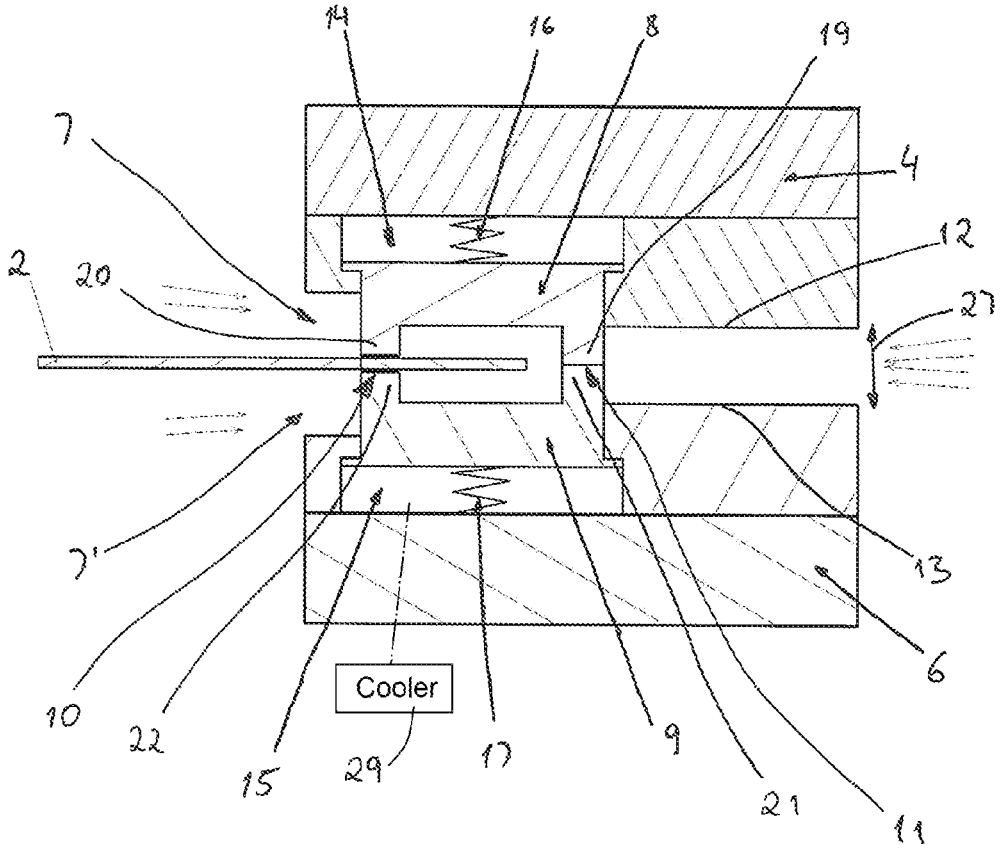
FIG. 3 is a cross section along line of FIG. 2.

FIG. 3 shows the first and second mask elements 4 and 6 and the part of the plate workpiece 2 covered between the mask elements 4 and 6 in cross-section. The mask elements 4 and 6 are arranged at a distance from each other and from the plate workpiece 2, so that a gap 7 is formed between the plate workpiece 2 and the first mask element 4 and a further gap 7' is formed between the plate workpiece 2 and the second mask element 6. The workpiece 2 is arranged between the mask elements without being touched by the mask elements 4 and 6 or the parts 3 and 5. This contact-free shielding enables low-cost and low-wear shielding.

The seals are fastened to the mask elements, a first seal 8 being fastened to the first mask element 4 and a second seal 9 arranged opposite the first seal 8 being fastened to the second mask element 6. Both seals 8 and 9 are adjusted relative to each other transversely to the plate workpiece plane into a working position. The adjustment direction transverse to the plate workpiece plane is shown in FIG. 3 by a double arrow 27.

The first part 3 with the first and further mask elements 4 and 4' formed thereon and the first seal 8 is congruent with the second part 5 with the first mask element 6 formed thereon and the further mask element as well as the second seal 9. In addition, the parts 3 and 5 together with the mask elements 4 and 6 are positioned congruently with each other. The seals 8 and 9 are arranged as a pair of seals opposite each other and congruent with each other so that their end faces lie exactly against each other in the working position. As a result, gaps 7 and 7' between the mask elements 4 and 6 are optimally closed.

The further first and second mask elements of which only the element 4' is shown also have further first and second seals 8 and 9 that are attached to the shield 1 as pairs of seals. These mask elements and seals are correspondingly congruent in design and are positioned congruently with one another.

The seals 8 and 9, which are arranged in pairs opposite each other, are of U-section. The first seal 8 has a long inner leg 19 and a short outer leg 20. The second seal 9 has a long second leg 21 and a short second leg 22. As shown in FIG. 3, in the working position the seals 8 and 9 are moved toward each other with the short legs 20 and 22 closely juxtaposed with a first strip 10 of the workpiece 2 so that the gaps 7 and 7' between the mask elements 4 and 6 and the workpiece 2 are almost completely closed and no more heat reaches the covered region of the workpiece 2. This avoids a transition area between the hard and soft areas in the workpiece after the subsequent shaping of the workpiece 2. A small gap remains between the confronting faces of the short legs 20 and 22 and the workpiece 2 in order to shield without contact. This makes shielding particularly cost-effective and low-wear.

The long legs 19 and 21 of the seals 8 and 9 lie against each other at a location 11 that is offset from the plate workpiece 2. As a result, the area contained between the mask elements 4 and 6 next to the workpiece 2 is completely closed and no heat can reach the edge area of the workpiece 2. Thus the U-shape of the seals 8 and 9 shields an edge of the plate workpiece 2 shielded in a simple manner by a single pair of seals. The area can be cooled to the desired temperature in a short time, since heat no longer reaches the shielded area. The time saved results in significant energy savings.

As shown in FIG. 3, the seals 8 and 9 are movable and held in respective confronting recesses or grooves 14 and 15 of the shield 1 so as to be displaceable transversely to the plane of the plate workpiece, namely in the direction of the double arrow 27. In a starting position not shown in the figures, the seals 8 and 9 are retracted into the respective recesses 14 and 15 so that the upper first seal 8 terminates with its end face flush with a lower face 12 of the mask element 4 facing the workpiece 2, and the lower second seal 9 has its end face flush with an upper face 13 of the mask element 6 facing the workpiece 2 in the starting position. Thus, the spacing between the mask elements 4 and 6 is freely accessible and is not limited by parts of the projecting seals 8 and 9. The workpiece 2 can be placed in a simple manner between the mask elements 4 and 6 without touching the seals 8 and 9 or jamming when it is pushed in between the mask elements 4 and 6.

After shifting the seals 8 and 9 into the working position as shown in FIG. 3, the seals 8 and 9 then project beyond the surfaces 12 and 13 of the mask elements 4 and 6 and into the gap between the mask elements 4 and 6. The gap between the mask elements 4 and 6 and the gaps 7 and 7' between the mask elements 4 and 6 and the workpiece 2 are at least partially closed by the seals 8 and 9 in the working position.

The recesses 14 and 15 are grooves extending along a certain length of the corresponding orifice plate 4 and 6. The bar seals 8 and 9 have a length corresponding to the length of the channel and are held and slidably guided piston-style in the respective channel.

The seals 8 and 9 can be composed of several seals, for example to be able to shield complicated geometries. For this purpose, for example, a large number of seals can be placed next to or against each other, which together form a seal 8 and 9.

The shield 1 is connected to a cooler 29. The system pressure of the coolant supply is used to move the seals 8 and 9 into the working position. A coolant flows through the shield 1 as soon as it is put into operation in a furnace. The system pressure in the cooler acts hydraulically or pneumatically on the seals 8 and 9 so that these are at least partially pressed like pistons out of the respective recess 14 and 15 and the working position. In this way, a particularly simple and cost-effective actuation is possible. The return of the seals 8 and 9 to the starting position is effected by tension springs 16 and 17 held in the recesses 14,15 and serving to pull the seals 8 and 9 back into the respective recesses 14 and 15 after the pressure in the cooler 29 has dropped.

The seals 8 and 9 are separate components and are detachably attached to the shield 1. This has the advantage that the seals 8 and 9 can be replaced by seals with other dimensions and that the shield 1 can be used for plate workpieces 2 of different thicknesses.

The invention is not limited to the embodiments, but is variable in many ways within the scope of the disclosure.

All individual and combination features disclosed in the description and/or drawing are considered essential to the invention.

We claim:

1. A method of tempering a plate by:

fitting the plate between first and second parts having respective first and second mask elements having respective first and second faces covering only an edge region of the plate while leaving a more central region of the plate exposed; and heating in an oven the plate fitted between the first and second faces of the first and second mask elements, the first and second parts also having respective first and second recesses; and displacing first and second seals on the first and second parts confronting each other and in the respective first and second recesses on the respective first and second parts transversely of a plane of the plate between a working position in which the first and second seals are closely juxtaposed and inner portions of the first and second seals are spaced apart by a distance equal to a thickness of the plate and outer portions of the first and second seals bear on each other and a starting position spaced more widely from and out of engagement with each other, the first and second seals engaging and clamping the plate in the working position, the first seal being completely in the first recess in the starting position and terminating at least flush with the first face of the first mask element facing the plate or recessed in the first face, the second seal being completely recessed in the second recess when in the starting position and terminating at least flush with the second face of the second mask element facing the plate or recessed in the second face, the first and second seals projecting beyond the first and second faces when in the working position.

2. The method according to claim 1, wherein the first and second mask elements and the first and second seals thereon are formed congruently with respect to one another and are arranged congruently opposite one another.

3. The method according to claim 1, wherein the first seal in the starting position terminates with a n first end face at least flush with the first face of the first mask element facing the plate or is recessed in the first face of the first mask element and the second seal in the starting position terminates with a n second end face at least flush with the second face of the second mask element facing the plate or is recessed in the second face, the first and second seals projecting in the working position beyond the respective first and second faces of the first and second mask elements.

4. The method according to claim 1 wherein each of the first and second seals is formed by several parts.

5. The method according to claim 1, wherein the first and second recesses form with the respective first and second parts a pressurizable chamber, the method further comprising:

supplying the first and second recesses with a pressurized coolant that both cools the respective first and second seals and also shifts the first and second seals into the working position.

6. The method according to claim 1, the method further comprising urging the first and second seals into the working position.

7. The method according to claim 1, wherein each of the first and second seals is of U-shape in section and has a short inner leg and a long outer leg projecting at a spacing and parallel toward the plate and of lengths such that in the working position the short inner legs are closely juxtaposed with the plate and the long outer legs engage each other and form a closed chamber around an edge of the plate.

8. The method according to claim 1, wherein each of the first and second parts has two of the respective first and second mask elements.

9. The method according to claim 1, wherein the first and second parts and the respective first and second mask elements are unitary.

10. The method according to claim 1, wherein the first and second parts and the first and second mask elements are formed in multiple parts and are detachably connected to each other.

11. The method according to claim 1, wherein each of the first and second parts is formed in multiple parts.

12. A shield used in the method of claim 1 and formed by the first and second parts, the first and second mask elements, and the first and second seals.

* * * * *